US007053860B1

(12) United States Patent
Guo

(10) Patent No.: US 7,053,860 B1
(45) Date of Patent: May 30, 2006

(54) EXTERNAL ANTENNA

(76) Inventor: Pony Guo, P.O. Box 166-13, Taipei (TW) 115

( * ) Notice: Subject to any disclaimer, the term of this patent is extended or adjusted under 35 U.S.C. 154(b) by 0 days.

(21) Appl. No.: 11/068,457

(22) Filed: Feb. 28, 2005

(51) Int. Cl.
*H01Q 9/30* (2006.01)

(52) U.S. Cl. ..... 343/900; 343/715; 343/713; 343/711

(58) Field of Classification Search ..... 343/900, 343/711
See application file for complete search history.

(56) References Cited

U.S. PATENT DOCUMENTS 4,190,839 A * 2/1980 Liautaud ..... 343/715
5,568,156 A * 10/1996 Terashima et al. ..... 343/713
6,023,245 A * 2/2000 Gomez et al. ..... 343/725
6,288,684 B1 * 9/2001 Wiggenhorn et al. ..... 343/713
6,538,611 B1 * 3/2003 Noro ..... 343/725
6,784,850 B1 * 8/2004 Morooka et al. ..... 343/895
6,788,261 B1 * 9/2004 Buren ..... 343/715

* cited by examiner

*Primary Examiner*—Don Wong
*Assistant Examiner*—Binh Van Ho

(57) ABSTRACT

The present invention is aimed to provide an external antenna to adapt to the wireless communication device for receiving and transmitting signals by means of double attachable functions (magnetic/on glass/patch). The external antenna is portable and retractable, and easy to assemble and detach.

An external antenna comprises a base, a connector is disposed on the proximal end of the base, an antenna fits into the connector, a metal cap is disposed under the distal end of the base, a magnet fits in the metal cap, a sucking disk disposed under the magnet screwed into the cap, a conductor is extended between said base and a coaxial connector, thus they are combined to form an external antenna.

The external antenna can be attached to a flat surface of objects by sucking disk or magnet.

5 Claims, 6 Drawing Sheets

EXTERNAL ANTENNA

FIELD OF THE INVENTION

The present invention is related to an electronic communication device. An external antenna is used to receive or emit the signals.

STATE OF THE PRIOR ART

The electronic communication products applied to receive wireless signals is a well-known fact, such as the old time radio and television, only broadcast in the scope of one-way transmitted wireless signals. Recently, the concurrent bi-directional communication technique is adopted as many mainstream techniques such as the GSM, PHS, blue tooth or other related computer interface communication techniques. However, the operation of one-way or bi-directional communication technique is characteristic of an external antenna to receive, to transmit the signals. Under the never-ending changes and improvements of scientific progress circumstance, the capacity, and length of the antenna is approached to relatively simple and small in concrete implementation. No matter what kind of options about the frequency, power ratio, or specification are specified, the position and angle of the external antenna will be a determined factor about the communication effect.

Most of the earlier electronic communication products are used with an attached antenna kit. Under an easy-to-use consideration, the antenna is integrally designed as built-in hidden in the electronic communication products. The consumers may prefer the built-in antenna than outstretched mast-like antenna. Nevertheless, the hidden antenna is hard to adjust the angle to receive signals; the hidden antenna leads to a blind spot of electronic communication and degrades the quality of the signals.

Therefore, a separable external antenna kit is popular day by day; for example, such as a notebook for single user during an off-line operation, a separable antenna kit can be separated from the notebook. While a single user needs to forward an E-mail or process wireless access point to receive some information, a separable antenna should be prepared to connect the wireless local LAN. At this time, a separable and portable antenna in person is on demand to receive and transmit signals.

BACKGROUND OF THE INVENTION

As usual, a base of an external antenna secures the objects by bolting; a lug and a bolt are combined to screw the antenna base on the surface of the objects. Before being screwed with a bolt, a threaded bolt bore is drilled on the surface of the objects. Thus drilling causes rust and undergoes destructive changes for a planish, smooth looking on the surface of the objects. To assemble and detach a lug bolt is a difficult, troublesome task.

Or a base of an external antenna secures the objects by clamping. The clamp is easy to damage the lacquer, paint or coating on the surface of the objects. Detach the clamp from the objects is a tiresome work.

Or a base of an external antenna secures the objects by magnet. The magnet is lack of attraction for nonmetallic materials; the magnetic field interference may lead to distortion of the waveform or noise of the voice frequency with the electronic products. The magnet must keep away from electronic products.

Or a base of an external antenna secures nonmetallic objects by sucking disk. The surface of the nonmetallic objects must be a delicate flat and waxen-like in appearance. Otherwise, the sucking disk sticks to the surface only in a short time. The external antenna will be dropped off the nonmetallic surface.

Point against the aforesaid defects, how to design a portable, separable external antenna, being avoid from magnetic field interference about electronic products, and attached to the surface of the objects (metallic or nonmetallic) as an joint base will be concerned by the inventor of the present invention.

SUMMARY OF THE INVENTION

Accordingly, the primary object of the present invention is aimed to provide an external antenna is portable, particularly separable easily from the attached surface of the object.

The second object of the present invention is to provide an external antenna may exempt from the magnetic field interference about the electronic products.

The third object of the present invention is to provide an external antenna being attached to the surface of the metallic or nonmetallic objects combined to form as a joint base.

To achieve the aforesaid objects, the present invention provides an external antenna as claim 1 claimed:

a base is shaped as a hollowed-out conic plastic house with a through bore on the proximal end, an open trough on the distal end, and a lateral throughout conduit;

an antenna connector fits into the proximal through hole of the base;

an antenna fits onto the proximal end of the antenna connector;

a metal cap fits onto the distal open trough of the base;

a magnet inlaid in the concave trough of the cap;

a sucking disk has a bolt passed through the central bore of the magnet and then screwed into the central bore of the metal cap; and a conductor is passed through and fits into the lateral conduit of the base, the first end of an axis is connected with the antenna connector, the first end of another axis is connected with the metal cap, the second ends of the axes are connected with the same co-axial connector;

Thus, the antenna base can be attached to the surface of non-metallic materials by sucking disk, and can be attached to the surface of metallic materials by magnet.

To achieve the aforesaid objects, the present invention provides an external antenna as claim 2 claimed, a sucking disk is composed of a hardening plastic bolt disk and a soft gum-like conic disk, the proximal end of the bolt disk has a bolt, the distal end of the bolt disk has an expanded positioning disk, the conic disk directly encloses the positioning disk and then combined to form as an integral whole one.

To achieve the aforesaid objects, the present invention provides an external antenna as claim 3 claimed, the distal end of an antenna has a positioning bolt to adapt to the bolt bore formed on the proximal end of the antenna connector.

To achieve the aforesaid objects, the present invention provides an external antenna as claim 4 claimed, a through bore of the base has a preset annular positioning groove to adapt to the annular convex positioning ring along the rim of the antenna connector.

To achieve the aforesaid objects, the present invention provides an external antenna as claim 5 claimed, the metal cap has a projected piece with bore formed by pressure of a die, which is adapted to connect an axis of a conductor.

CONTRAST BETWEEN THE PRESENT INVENTION AND THE PRIOR ARTS

By means of the practice of the present invention, the advantages can be achieved as following:

Said antenna base can be attached to a delicate, flat surface of the objects, such as plastic steel, glass, metal plate or selections from other flat and smooth surface of materials. After the sucking disk is detached, the antenna base can be attached to metal materials, such as metal table surface, closet surface, aluminum composite panel of car etc., the user can stack or detach the antenna base firmly and rapidly.

Said sucking disk is composed of tough hardening bolt and soft gum-like conic disk combined to form an integral sucking disk, thus the sucking disk keeps stable configuration and in concrete implementation of sucking capacity.

Said antenna base has a positioning bolt to adapt to the bolt bore formed on the proximal end of the antenna connector to achieve a firmly and rapidly stable connection effect.

Said through bore of the base has an annular positioning groove adapted to the annular positioning ring along the rim of the antenna connector to achieve a firmly and rapidly stable connection effect.

Said projected piece with bores on the metal cap, which is punctuated by a pressure of a die, is adapted to an axis of the conductor to connect with the metal cap firmly.

BRIEF DESCRIPTIONS OF THE DRAWINGS

DETAILED DESCRIPTION OF THE PREFERRED EMBODIMENTS

According to the appended drawings, the description is described thereafter.

Figure 1:
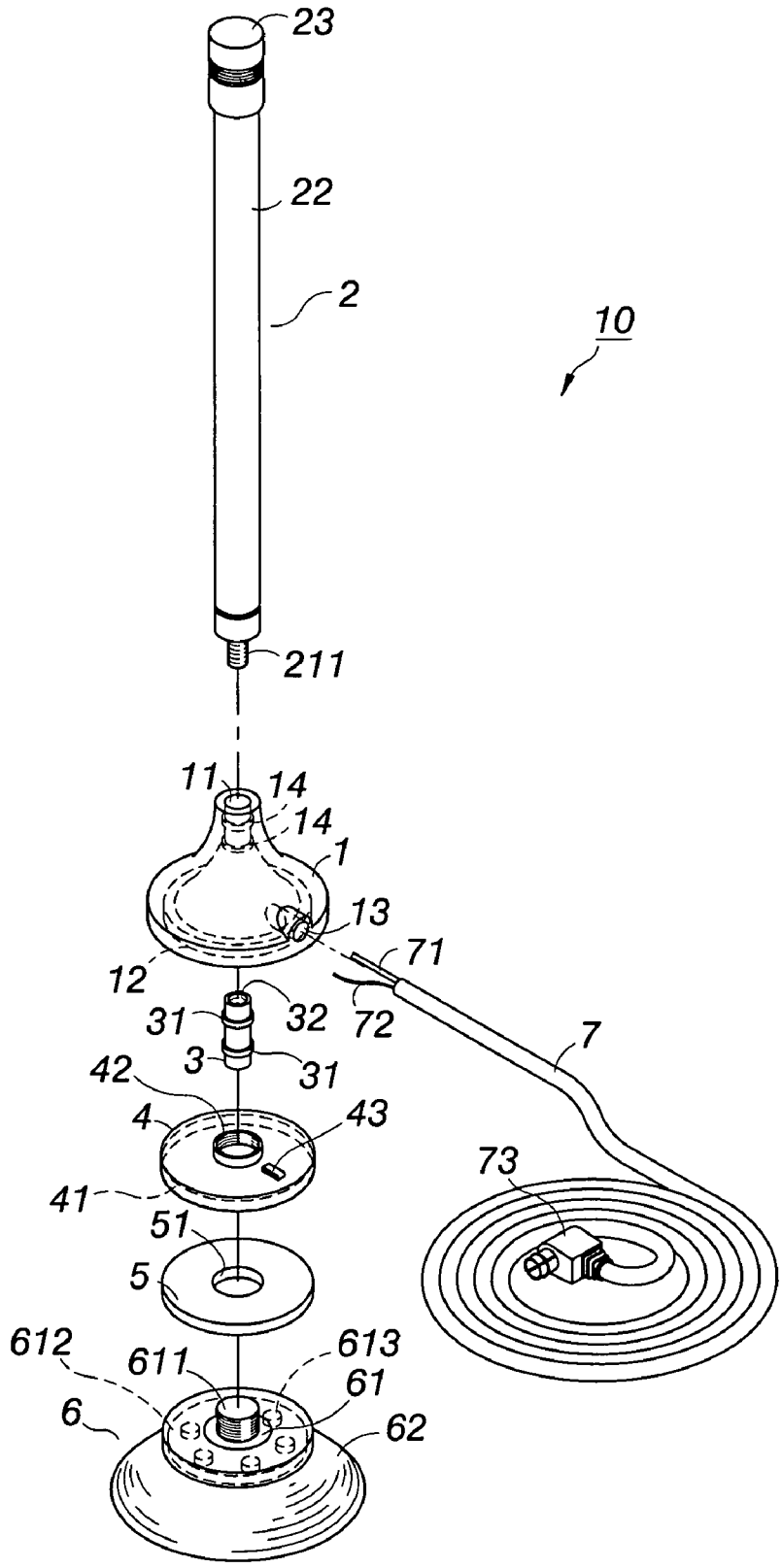
FIG. 1 is a perspective exploded view of the present invention.
Figure 2:
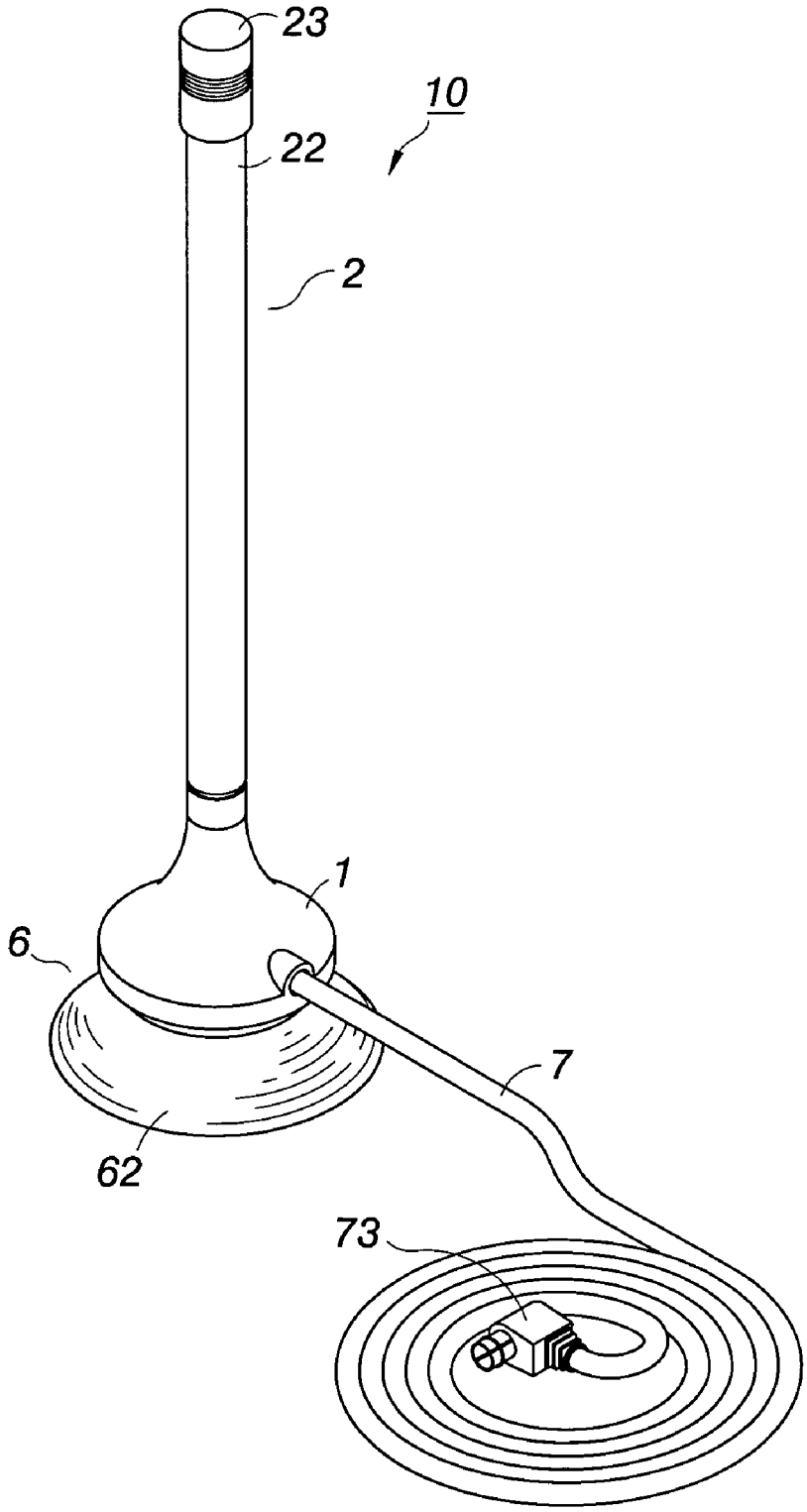
FIG. 2 is a perspective assembly view of FIG. 1.

FIG. 1 a perspective exploded view of the external antenna is shown. The antenna base 10 comprising a base 1, an antenna connector 3 is disposed on the proximal end of the base 1, an antenna 2 fits into the antenna connector 3, a metal cap 4 fits into the distal end of the base 1, a magnet 5 is clamped and inlaid in the metal cap 3, a sucking disk 6 is disposed under the magnet 5 and secured the metal cap 3 by screwing, one end of the conductor 7 is threaded into the base 1 and the other end is secured to the co-axial connector 73, aforesaid components are combined to form an external antenna 10. An assembly view of the present invention is shown as FIG. 2.

Said base 1 is a hollowed-out conic plastic house formed in a bell shape which is broad at the distal end, a through bore 11 is formed through the proximal end, and an open trough 12 is formed on the distal end, a conduit 13 is formed through the lateral side of the base 1. An annular positioning groove 14 is formed within the distal end of the through bore 11.

Figure 3:
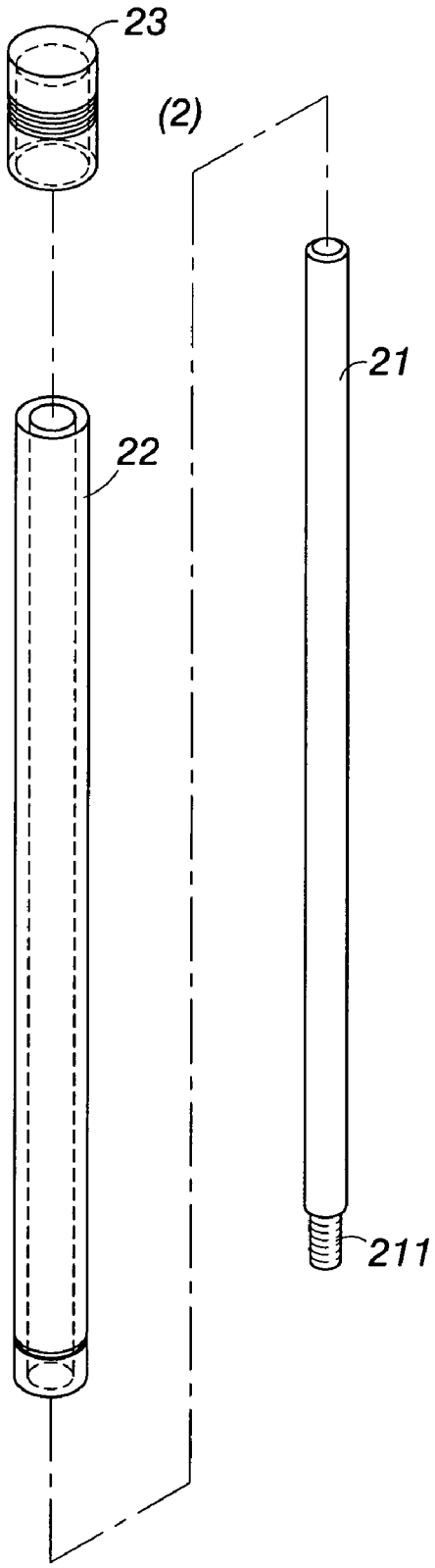
FIG. 3 is an exploded view of the antenna of FIG. 1.

FIG. 3 is illustrated, said antenna 2 includes a mast-like receiver 21, a tubular sleeve 22 fits over the rim of the receiver 21, and a cap tube 23 fits over the proximal end of the receiver 21 and tubular sleeve 22. Aforesaid components thus are combined to form an antenna 2. In that, a positioning bolt 211 of antenna is disposed at the distal end of the mast-like receiver 21. Said positioning bolt 211 is applied to secure the antenna 2 to the antenna connector 3.

Said antenna connector 3 is a tubular connector with an annular bulged out positioning ring 31 along its circumference, can be clamped and inlaid in the annular positioning groove 14 of said through bore 11 of the base 1. A bolt bore 32 is formed at the proximal end of the antenna connector 3 is adapted to fit the positioning bolt 211 of the distal end of the antenna 2.

Said metal cap 4 is clamped and inlaid in an open trough 12 formed on the distal end of the base 1. A hollowed-out conic trough 41 is formed on the distal end of the metal cap 4. And a bolt bore 42 is formed at the center of the distal end of the metal cap 4. For being prolonged the bolt bore 42 with a suitable length by protruding upward the inner wall of the bolt bore 42, the proximal end of the cap 4 is punctuated by a pressure of a die to form a projected piece 43 with bores as desired.

Said magnet 5 is a circular magnetic plate, fits into an open tough 41 of said metal cap 4 to impose spatial magnetic attraction. Further, glues the magnet to the metal cap 4 by adhesive. Moreover, a central through bore 51 of the magnet 5 is aligned with the bolt bore 42 of said metal cap 4. Before touching on the metal objects, a spatial magnetic attraction is imposed between the metal objects and the antenna base due to the magnet 5 could pull the metal cap 4 close to the metal material.

Figure 4:
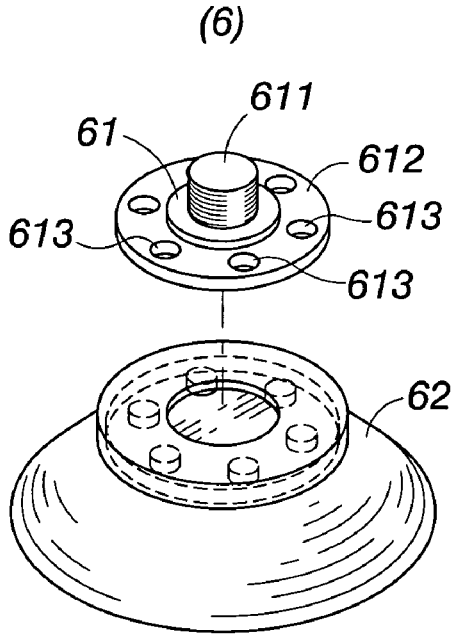
FIG. 4 is an exploded view of the sucking disk of FIG. 1.

As the FIG. 4 is shown, a tough hardening plastic bolt disk 61 and a soft gum-like conic disk 62 are combined to form a sucking disk 6. The bolt disk 61 is made of harden materials such as ABS. The soft gum-like conic disk 62 is made of elastic materials such as PVC be able to directly enclose said positioning disk 612. To avoid the positioning disk 612 from swift movements with conic disk 62, positioning bores 613 are formed along the rim of the positioning disk 612 for injecting into a melt rubber. Particularly after the conic disk is formed by injection mold, aforesaid positioning bores injected melt rubber may combine the positioning disk 612 with conic disk 62 as an integral disk. Further, the conic disk 62 is shaped as a hollowed-out conic disk at the distal end of the integral disk. When touching the flat or smooth surface of the objects, the integral disk can be pressed to dispel the dead air out of the integral disk thus the integral disk achieves a vacuum self-absorption effect.

Figure 5:
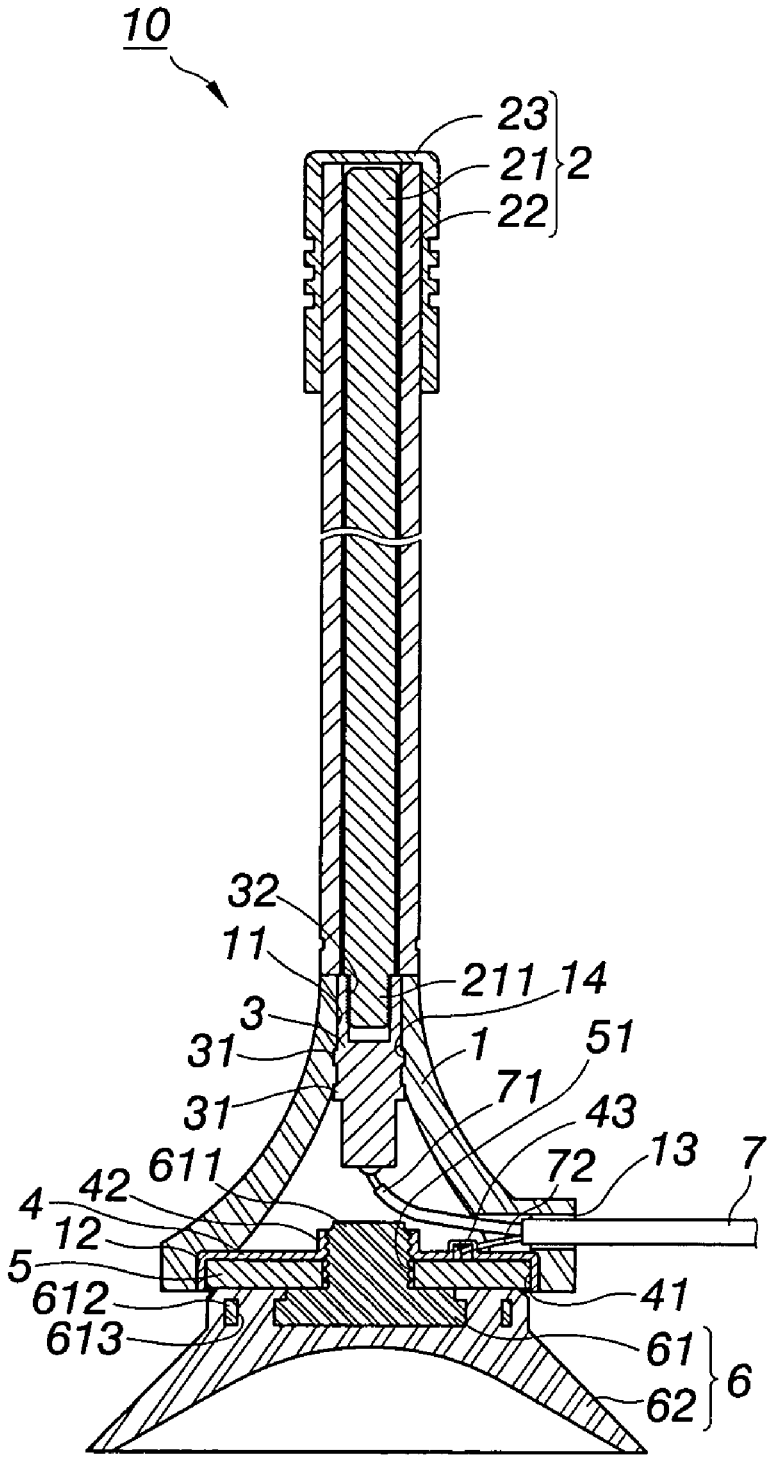
FIG. 5 is a perspective view of the external antenna base.

Said conductor 7 can be a co-axial cable, the insulating tube has separated axes 71, 72. The terminals of the axes 71, 72 are connected with a co-axial connector 73. The second ends of the axes 71, 72 are connected with the antenna connector 3 and metal cap 4 respectively. FIG. 5 is illustrated the connective ways such as the first end of the axis 71 is connected with the distal end of the antenna connector 3, and the first end of the axis 72 is connected with the preset projected piece 43 of the metal cap 4. Welding is preferred options for axes 71, 72 of conductor 7 to connect the co-axial connector 73, metal cap 4, and antenna connector 3.

FIG. 5 is illustrated, said sucking disk 6 is disposed under the magnet 5, a screw bolt 61 on the proximal end of the sucking disk 6 passed through the through bore 51 of the magnet 5 and then screwed into the central bore 42 of the metal cap 4, thus secured the sucking disk 6 to the metal cap 4 by screwing bolt. Conversely the screw bolt 61 can be drawn out the bolt bore 42 easily in reverse direction. Therefore, to assemble and disassemble the sucking disk 6 is easy to do at the user's convenience.

Figure 6:
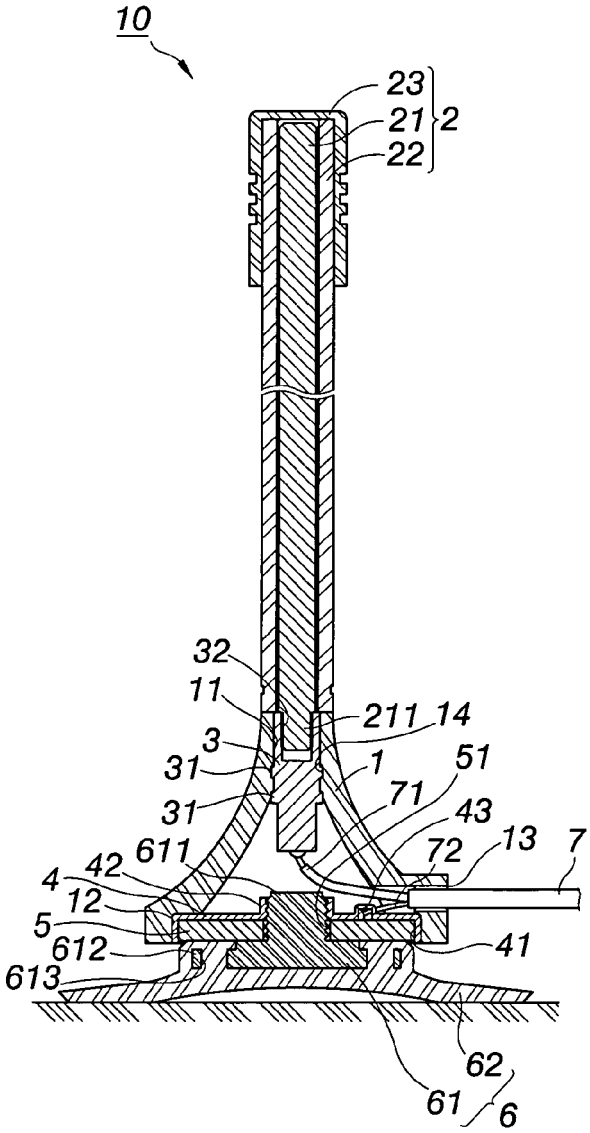
FIG. 6 is a diagram view of the antenna base in use with a sucking disk.

FIG. 6 is illustrated, as the antenna base 10 is to locate on the smooth surface of the non-metal objects, the sucking disk 6 may be pressed down to dispel the dead air from the hollowed-out conic distal end to produce a corresponding vacuum self-absorption effect and locate the antenna base on the smooth surface.

Figure 7:
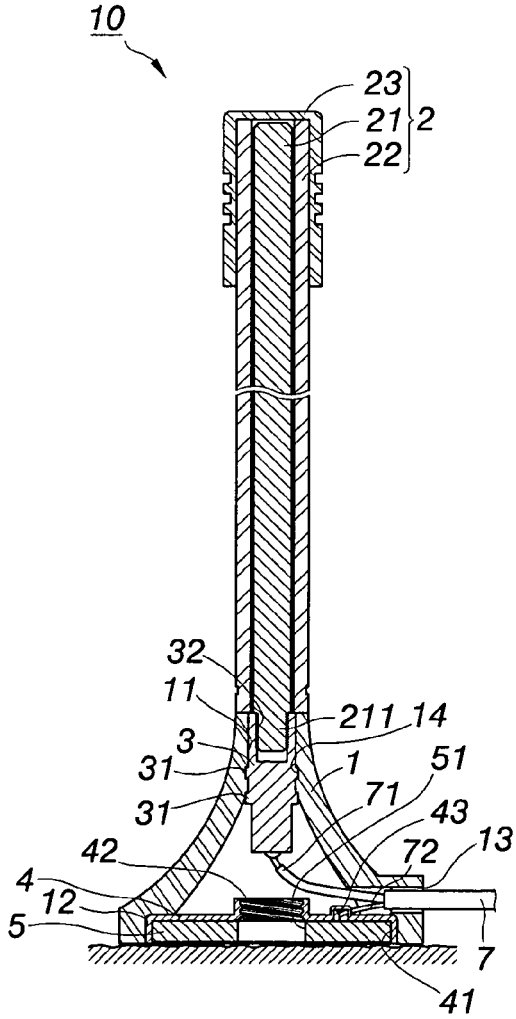
FIG. 7 is a diagram view of the antenna base in use with a magnet.

FIG. 7 is illustrated, as the antenna base 10 is to locate on the metal surface, after detaching the sucking disk 6 from and then attaching to the metal surface includes the attraction for magnet and the metal surface. Thus the antenna base 10 is easy to cause to stand on the selected spot.

Figure 8:
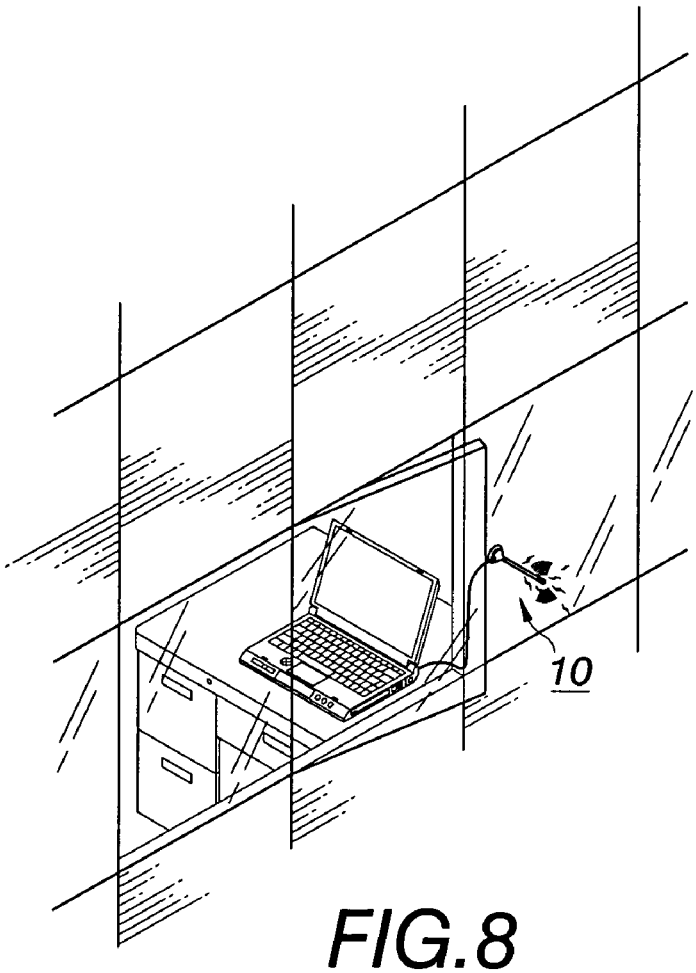
FIG. 8 is a diagram view of the antenna base attached to a glass surface.
Figure 9:
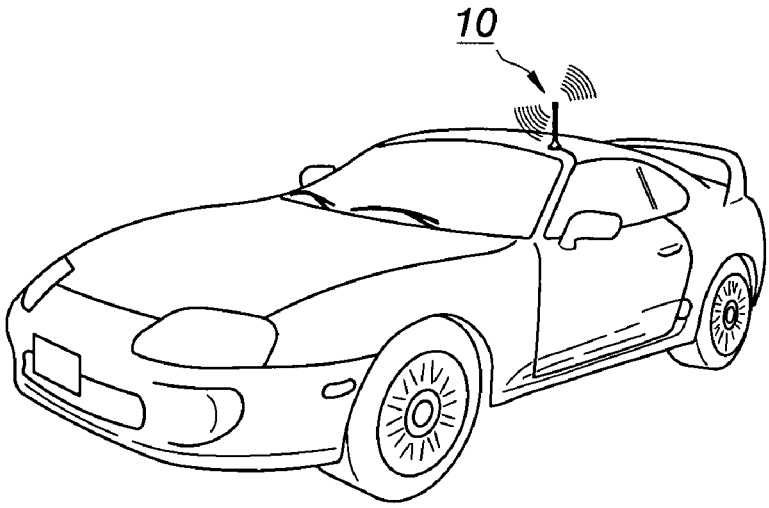
FIG. 9 is a diagram view of the antenna base attached to aluminum composite plate of car.

As the FIGS. 8 and 9 are illustrated, the antenna base 10 of the present invention are exemplified two different diagrams applied to the window glass by sucking disk or to the aluminum composite plate of car by magnet. FIG. 8 is illustrated, in general office building, decorative glass of windows has been processed through thermal insulation and sound reduction treatments, which may lead to distortion or noise of the wireless electromagnetic waves or communication signals. Therefore, attaches the antenna base 10 of the present invention to the surface of the desk or glass, can receive signals with improved communication effects. Moreover, as the FIG. 9 is illustrated, electronic appliances used in car such as TV, Hi-Fi Stereo, locator device, or communication products such as telephone, walkie-talkie, or surf internet by portable notebook, may attach the sucking disk 6 of the antenna base 10 to the surface of the desk or glass, or attach the magnet 5 to the aluminum composite plate of the car, thus achieve better communication effects.

The above embodiments are only used to illustrate the present invention, not intended to limit the scope. Many modifications of the embodiment can be made without departing from the spirit of the present invention.

What is claimed is:

1. An external antenna comprises: a base is shaped as a hollowed-out conic plastic house with a through bore on the proximal end, an open trough on the distal end, and a lateral throughout conduit; an antenna connector fits into the proximal through hole of the base; an antenna fits onto the proximal end of the antenna connector; a metal cap fits onto the distal open trough of the base; a magnet is inlaid in the concave trough of the cap; a sucking disk has a bolt passed though the central bore of the magnet and then screwed into the central bore of the metal cap; and a conductor is passed through and fits into the lateral conduit of the base, the first end of an axis is connected with the antenna connector, the first end of another axis is connected with the metal cap, the second ends of the axes co-axial connector; Thus, the antenna base is attached to the surface of are connected with the same non-metallic materials by sucking disk, and is attached to the surface of metallic materials by magnet.

2. The external antenna as claim 1 claimed, in that, a sucking disk is composed of a hardening plastic bolt gum-like conic disk, the proximal end of the bolt disk has a bolt, the distal end of the bolt disk has an expanded positioning disk, the disk and a soft conic disk directly encloses the positioning disk and then combined to form as an integral disk.

3. The external antenna as claim 1 claimed, in that, the distal end of an antenna has a positioning bolt to adapt to the bolt bore formed on the proximal end of the antenna connector.

4. The external antenna as claim 1 claimed, in that, a through bore of the base has a preset annular positioning groove to adapt to the bulged out positioning ring along the circumference of the antenna connector.

5. The external antenna as claim 1 claimed, in that, the metal cap has a projected piece with bore formed by pressure of a die, which is adapted to connect an axis of a conductor.

* * * * *